US011913307B2

(12) United States Patent
Richards et al.

(10) Patent No.: US 11,913,307 B2
(45) Date of Patent: Feb. 27, 2024

(54) PRESSURE CONTROL VALVE

(71) Applicant: Schlumberger Technology Corporation, Sugar Land, TX (US)

(72) Inventors: Edward Richards, Cheltenham (GB); Christopher Rowe, Chalford (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 90 days.

(21) Appl. No.: 17/639,922

(22) PCT Filed: Sep. 2, 2020

(86) PCT No.: PCT/US2020/048982
§ 371 (c)(1),
(2) Date: Mar. 3, 2022

(87) PCT Pub. No.: WO2021/046075
PCT Pub. Date: Mar. 11, 2021

(65) Prior Publication Data

US 2022/0341287 A1 Oct. 27, 2022

Related U.S. Application Data

(60) Provisional application No. 62/895,130, filed on Sep. 3, 2019.

(51) Int. Cl.
*E21B 34/10* (2006.01)
*E21B 23/04* (2006.01)

(52) U.S. Cl.
CPC ..... *E21B 34/10* (2013.01); *E21B 23/04* (2013.01)

(58) Field of Classification Search
CPC ..... E21B 21/10; E21B 21/0103
See application file for complete search history.

(56) References Cited

U.S. PATENT DOCUMENTS

| | | | | |
|---|---|---|---|---|
| 3,698,426 | A * | 10/1972 | Litchfield | E21B 21/106 137/496 |
| 4,532,614 | A | 7/1985 | Peppers | |
| 2007/0181313 | A1* | 8/2007 | Churchill | E21B 23/006 166/374 |
| 2011/0073295 | A1 | 3/2011 | Steele et al. | |
| 2015/0300160 | A1 | 10/2015 | Logan et al. | |
| 2017/0204690 | A1* | 7/2017 | Hess | E21B 41/0085 |
| 2018/0329093 | A1 | 11/2018 | Kusko et al. | |

FOREIGN PATENT DOCUMENTS

CA 2539266 A1 4/2007

OTHER PUBLICATIONS

International Search Report and Written Opinion in International Patent Application No. PCT/US2020/048982, dated Dec. 10, 2020, 18 pages.

Exam Report under Section 18(3) issued in United Kingdom Patent Application No. GB2202937.5 dated Dec. 19, 2022, 4 pages.

* cited by examiner

*Primary Examiner* — Cathleen R Hutchins

(57) ABSTRACT

A pressure control valve for a downhole drilling system includes a choke body and a restrictor body. The choke body is installed in the bore of a housing. A fluid flow flows through an orifice in the choke body. Changing a distance between the choke body and the restrictor body changes a pressure differential uphole of the pressure control valve.

20 Claims, 15 Drawing Sheets

PRESSURE CONTROL VALVE

CROSS-REFERENCE TO RELATED APPLICATIONS

This application claims priority to and the benefit of U.S. Provisional Application No. 62/895,130 filed on Sep. 3, 2019 the entirety of which is incorporated herein by reference.

BACKGROUND OF THE DISCLOSURE

During downhole drilling operations, downhole tools may operate with a pressure differential. The pressure differential is determined by the hydraulic resistance to flow through the downhole drilling system. The pressure differential may be increased by installing a nozzle at one or more exhaust locations. A common exhaust port is at the bit, where a nozzle helps to direct the flow to cool the bit and flush cuttings uphole. Some downhole tools operate with an optimal pressure differential.

SUMMARY

In some embodiments, a downhole flow system includes a housing with a bore therethrough. A fluid flow flows through the bore. A port directs a portion of the fluid flow to a downhole tool operable by the fluid flow. A pressure control valve is located in the bore downhole of the port, the pressure control valve includes a flow restrictor and an actuator connected to the flow restrictor. The actuator changes a position of the flow restrictor to adjust a pressure differential uphole of the pressure control valve.

In some embodiments, a downhole flow system includes a housing with a bore therethrough. A port directs flow to a downhole tool operable by a fluid flow. A pressure control valve in the bore downhole of the port includes a choke body in the bore. The choke body includes an orifice having an orifice diameter that is less than the bore diameter. A flow restrictor has a flow restrictor diameter that is greater than the orifice diameter. A resilient member urges the choke body toward the flow restrictor.

In some embodiments, a method for controlling pressure at a downhole tool includes flowing a fluid flow through a bore in a housing. The bore includes a pressure control valve. The fluid flow has a first drilling property and a pressure differential uphole of the pressure control unit. A portion of the fluid flow is directed to the downhole tool uphole of the pressure control valve. The first drilling property is changed to a second drilling property. A flow restrictor is adjusted in the pressure control valve with an actuator in response to changing the first drilling property to the second drilling property. Adjusting the flow restrictor maintains the pressure differential above the pressure control valve.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 4-1 and FIG. 4-2 are cross-sectional views of a representation of a pressure control valve, according to at least one embodiment of the present disclosure;

FIG. 5-1 and FIG. 5-2 are cross-sectional views of another representation of a pressure control valve, according to at least one embodiment of the present disclosure;

FIG. 6-1 through FIG. 6-3 are cross-sectional views of yet another representation of a pressure control valve, according to at least one embodiment of the present disclosure;

FIG. 7-1 through FIG. 7-4 are cross-sectional views of still another representation of a pressure control valve, according to at least one embodiment of the present disclosure.

DETAILED DESCRIPTION

Figure 1:
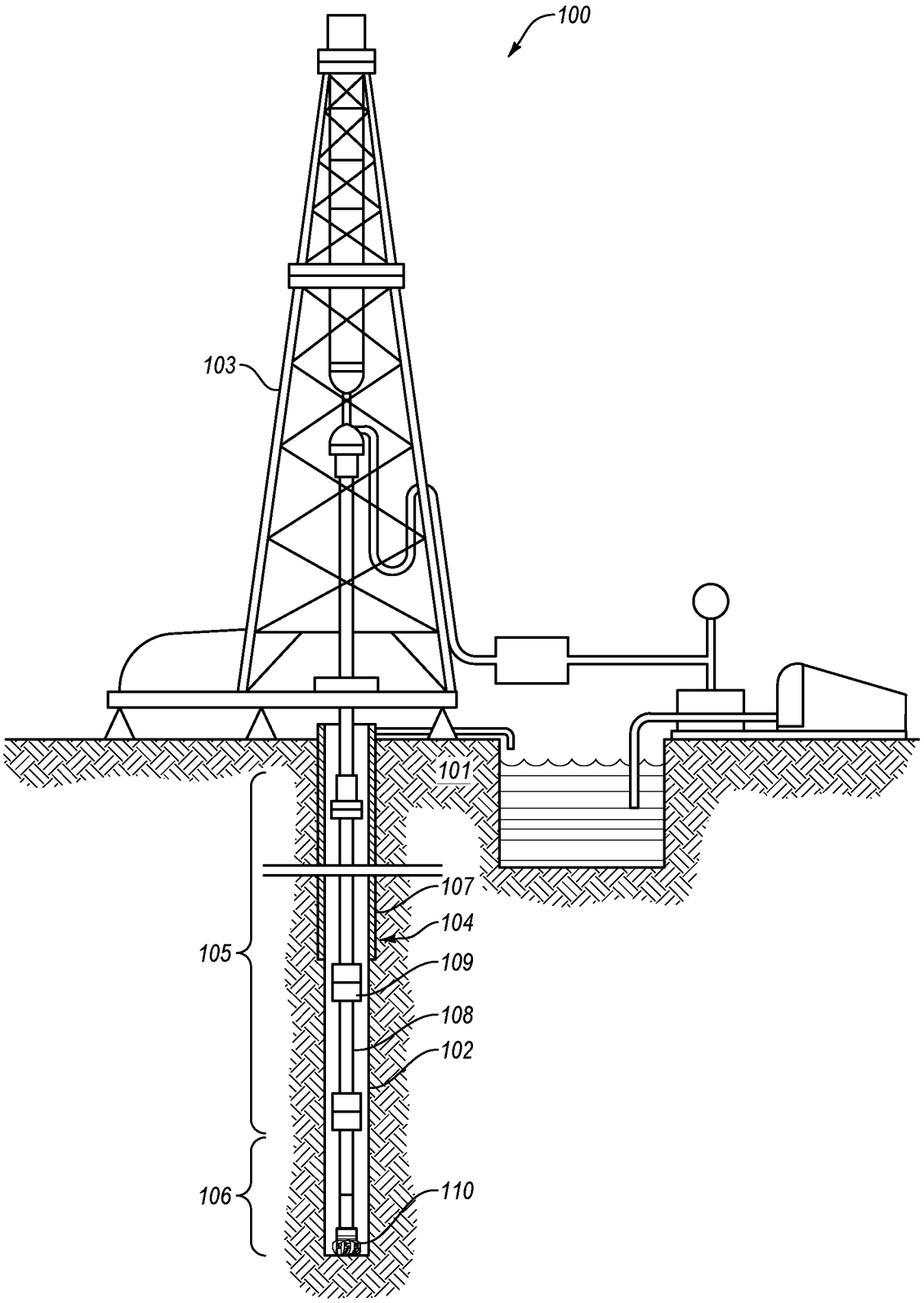
FIG. 1 is a schematic representation of a drilling system, according to at least one embodiment of the present disclosure.

This disclosure generally relates to devices, systems, and methods for controlling downhole pressure differential uphole of a pressure control valve. When drilling a wellbore, drilling fluid is pumped through a series of tubular members to a bit. Differential pressure between the tubular members and an annulus between the tubular member and the wellbore wall may be maintained by one or more nozzles at the bit or within the bore of the tubular members. The differential pressure may drive one or more downhole tools. In some embodiments, one or more fluid properties of the fluid flow, such as fluid density or volumetric flow rate, may change during the course of drilling a wellbore. This may change the pressure differential, which may change how the downhole tool operates. During a drilling operation, the operator may desire to maintain a constant pressure differential or keep the pressure differential within a desired range. In some embodiments, to maintain a pressure differential range, the operator may maintain the fluid density or the volumetric flow rate within a specified range. However, changing drilling conditions may require a change in fluid density or volumetric flow rate, which may change the pressure differential. In some embodiments, a pressure control valve in the bore of the tubular members may maintain the pressure differential range. Controlling the pressure differential at the downhole tool may provide a finer degree of control over the downhole tool. This may provide an operator greater control over wellbore properties such as trajectory, rotational speed, provide an operator a wider operating range for drilling fluid volumetric flow rate and density, or combinations of the foregoing. These benefits may increase the drilling penetration rate, decrease the drilling cost per foot, improve wellbore accuracy, or combinations of the foregoing.

Multiple downhole tools may benefit from such control over the pressure differential. Expandable tools often utilize a hydraulically operated piston. The piston may not move outside of a specified pressure range. By controlling the pressure differential, the timing and/or the force of the extension of the piston may be controlled. A pressure differential may further protect an expandable tool (e.g., reamer, stabilizer, mill) from unintended or accidental expansion. This may be because the pressure control valve would not allow the pressure to reach the threshold unless actuated or unless the flow rate is increased above a specified rate. In some embodiments, an active pressure control valve may be closed to intentionally increase the pressure uphole of the pressure control valve and thereby activate a downhole tool (e.g., expand an expandable blade on a reamer, or the like), even in a low fluid flow/fluid density situation. Controlling the extension of pistons and the actuation of tools may save time and money by preventing tools from breaking, prevent damage to wellbores, prevent unnecessary wear on downhole tools, or combinations thereof.

In some embodiments a downhole power generator may have an optimal or preferred working pressure differential. A pressure control valve may control the pressure differential at the downhole power generator such that the power generator may be used in a variety of different locations downhole, and may help to prevent damage to the power generator due to overspeeding of the turbine, and prevent stall of the power generator due to low pressure.

In some embodiments, a port may direct a portion of the fluid flow to an expandable piston. The fluid flow may push against the expandable piston with a force based on the differential pressure. If the force is strong enough (i.e., if the differential pressure is great enough), then the expandable piston may move in the direction of the force (e.g., extend). Before, during and/or after the expandable piston has expanded, the portion of the fluid flow may exhaust to the annulus through an exhaust port.

Changing the force with which the expandable piston extends may change the operation of the downhole drilling system. For example, a rotary steerable system may include a plurality of expandable steering pads. The steering pads may expand and apply a pad force against the wellbore wall in response to the differential pressure. A greater pad force may increase the severity of the curve. Furthermore, a greater pad force may cause the steering pads to erode the wellbore wall, even when not actively curving the wellbore. Using a pressure control valve to regulate the pressure differential across the expandable steering pads may help to control the force with which the steering pads expand. This may provide an operator greater control over the wellbore trajectory, reduce or prevent unnecessary or undesired erosion of the wellbore wall, provide an operator a wider operating range for drilling fluid volumetric flow rate and density, or combinations of the foregoing.

In some embodiments, a downhole flow system includes a housing. A bore runs through the center of the housing. A fluid flow flows through the bore. In some embodiments, the fluid flow through the bore is a primary fluid flow. In other words, the bore is the primary fluid flow path from the surface to the bit, and the fluid flow is the main fluid flow from the surface to the bit. A portion of the fluid flow may enter a port and travel to the downhole tool (e.g., movable pistons of an RSS). A pressure control valve may be located downhole of the port. The pressure control valve is located in the bore of the housing, and may restrict an entirety of the fluid flow except that portion diverted to the downhole tool. In other words, an entirety of the fluid flow flowing through the bore downhole of the port may flow through the pressure control valve.

In some embodiments, the port may be located in a flow diverter connected to the housing. In some embodiments, the pressure control valve may be located in the flow diverter. In some embodiments, the flow diverter may include multiple flow diverter paths, and the pressure control valve may be located in each flow diverter path. In some embodiments, the pressure control valve may be located downhole of the flow diverter.

In some embodiments, the pressure control valve may provide resistance to the fluid flow. For example, the pressure control valve may include an obstruction to the fluid flow. In some embodiments, the pressure control valve may reduce the diameter of the flow path (e.g., the bore) of the fluid flow. This may allow the pressure control valve to increase the pressure differential uphole of the pressure control valve. This may increase the pressure differential at the port that opens to a tool path to the downhole tool (e.g., the RSS expandable pads). In this manner, the pressure control valve may maintain an increased pressured differential uphole of the pressure control valve despite low drilling fluid density and/or low volumetric flow rate.

In some embodiments, the pressure control valve may open a bypass flow channel to direct flow away from a downhole tool. For example, the pressure control valve which may open a port to a bypass flow channel. Fluid may flow through the bypass flow channel and away from a downhole tool downstream of the pressure control valve. This may help a downhole tool to maintain a working range of pressure differentials. In some embodiments, an active pressure control valve may open the port to the bypass flow channel to actively bleed off pressure from the downhole tool.

In some embodiments, the pressure control valve may be passively operated. For example, the pressure control valve may maintain a pressure differential that is powered by the force of the hydraulic fluid, or without electrical actuation. This may increase the drilling penetration rate, decrease the drilling cost per foot, improve wellbore accuracy, or combinations of the foregoing. Furthermore, a passively operated pressure control valve may be simple, easy to install and maintain, and reliable downhole.

In some embodiments, the pressure control valve may be actively operated. For example, the pressure control valve may include an electrical activation system, such as an electrical motor, a linear actuator, a solenoid, a voice coil, a piezoelectric material, a lead screw on a stepper motor, a hydraulic piston, an open circuit demand valve (e.g., a scuba regulator valve), other activation system, or combinations of the foregoing. Active control of the pressure control valve may allow an operator to determine or decide the pressure differential uphole of the pressure control valve, rather than maintain a pre-set pressure differential. This may increase the range of pressure differential available, the range of pad forces applied, the sensitivity/or responsiveness of a downhole drilling system, or combinations of the foregoing. This may increase the drilling penetration rate, decrease the drilling cost per foot, improve wellbore accuracy, or combinations of the foregoing.

In some embodiments, a pressure control valve may include a flow restrictor and a choke body. The choke body has an orifice that is smaller than the diameter of the bore. The flow restrictor may include a restrictor body located uphole of the choke body. In some embodiments, the restrictor body may be located downhole of the choke body. The restrictor body may at least partially block a flow of fluid through the orifice. In some embodiments, the restrictor body may be cylindrical. In some embodiments, the restrictor body may have any shape, including cylindrical, conical, frustoconical, pyramidal, frustum pyramidal, cubic, spherical, ellipsoidal, other shapes, or combinations of the foregoing.

In some embodiments, the volumetric flow rate used in a downhole drilling operation is selected based on the size of the downhole drilling tool. The approximate maximum volumetric flow rate is a function of tool size as shown in Eq. (1):

$$Q=(f)d \tag{1}$$

where Q is the volumetric flow rate and d is the tool size. It should be understood that the flow rate Q is an approximate maximum flow rate that may be used, and that more or less flow rate may be used, depending on the situation.

In some embodiments, the area of the orifice is dependent upon the flow rate, the coefficient of discharge, the fluid density, and the desired differential pressure drop across the orifice. The area of the orifice may therefore be approximated as shown in Eq. (2):

$$A = \frac{Q}{C_d}\sqrt{\frac{\rho}{2\Delta p}} \tag{2}$$

where A is the area of the orifice, Q is the volumetric fluid flow for the downhole tool, Cd is the coefficient of discharge for the orifice, p is the fluid density, and Δp is the desired change in pressure differential.

By solving Eq. (2) for Δp, the pressure differential may be modeled for a set orifice area, as shown in Eq. (3):

$$\Delta p = \frac{\rho}{2}\left(\frac{Q}{C_d A}\right)^2 \tag{3}$$

Thus, the change in the pressure differential across the orifice is dependent upon the fluid density, the volumetric flow rate, the coefficient of discharge, and the area of the orifice. During downhole drilling operations, the fluid density and/or the volumetric flow rate may be changed. This will change the pressure differential. To maintain a constant pressure differential, or to maintain the pressure differential within a set range, the coefficient of discharge and/or the area of the orifice may be changed. For example, for an increased fluid density or volumetric flow rate, to maintain a constant pressure differential, the coefficient of discharge and/or the area of the orifice may be reduced. Similarly, for a decreased fluid density or volumetric flow rate, to maintain a constant pressure differential, the coefficient of discharge and/or the area of the orifice may be increased.

The restrictor body has a restrictor diameter, and the orifice has an orifice diameter. In some embodiments, the restrictor diameter is sized relative to the orifice diameter with a restrictor diameter ratio. A larger restrictor diameter ratio may provide a greater increase in the pressure differential uphole of the pressure control valve. In some embodiments, the restrictor diameter ratio may be in a range having an upper value, a lower value, or upper and lower values including any of 50%, 60%, 70%, 80%, 90%, 100%, 110%, 120%, 130%, 140%, 150%, or any value therebetween. For example, the restrictor diameter ratio may be greater than 50%. In another example, the restrictor diameter ratio may be less than 150%. In yet other examples, the restrictor diameter ratio may be any value in a range between 50% and 150%. In some embodiments, it may be critical that the restrictor diameter ratio is greater than 100% to sufficiently increase the pressure differential uphole of the pressure control valve.

The restrictor body is offset from the orifice (e.g., the choke body) with a restrictor offset. The restrictor offset is an offset percentage of the orifice diameter. A smaller restrictor offset may decrease the coefficient of discharge, thereby increasing the pressure differential uphole of the pressure control valve. Similarly, a larger restrictor offset may increase the coefficient of discharge, thereby decreasing the pressure differential uphole of the pressure control valve. In some embodiments, the offset percentage may be in a range having an upper value, a lower value, or upper and lower values including any of 1%, 5%, 10%, 15%, 20%, 25%, 30%, 40%, 50%, 60%, 70%, 80%, 90%, 100%, or any value therebetween. For example, the offset percentage may be greater than 1%. In another example, the offset percentage may be less than 100%. In yet other examples, the offset percentage may be any value in a range between 1% and 100%. In some embodiments, the restrictor body may contact the choke body (i.e., a restrictor offset of 0 or an orifice diameter percentage of 0%). When the restrictor offset equals 0, a minimum volumetric flow rate must be reached before flow begins to flow through the orifice. In some embodiments, the restrictor body may be located further from the orifice or the choke body than an offset percentage of 100%. In some embodiments, it may be critical that the offset percentage is between 50% and 100% to provide a sufficient range of pressure differential based on changes to the fluid density and/or volumetric flow rate. In some embodiments, the restrictor offset may be non-zero. In other words, at least a portion of the fluid flow may always flow through the orifice, or there may permanently be space between the restrictor body and the choke body. At full extension, the choke body may not contact the restrictor body. This may allow at least some fluid to flow through the pressure control valve even at low volumetric flow rates.

In some embodiments, the restrictor offset may be adjustable. An adjustable restrictor offset may allow the pressure differential to be adjustable uphole of the restrictor offset. In some embodiments, the restrictor offset may be adjusted by moving the choke body relative to the restrictor body. In some embodiments, the restrictor offset may be adjusted by moving the restrictor body relative to the choke body. In some embodiments, both the restrictor body and the choke body may move relative to the housing.

In some embodiments, the restrictor body may remain fixed relative to the housing, one or more resilient members may urge the choke body toward the restrictor body with a resilient force. As the fluid flow flows through the orifice, the fluid flow may exert a downhole-facing fluid force on the choke body. The fluid force may urge the choke body away from the restrictor body, or downhole. When the operator changes one or more fluid properties, the fluid force on the choke body may change as well. If the fluid force is greater than the resilient force, the choke body may move away from the restrictor body, or downhole. If the resilient force is greater than the fluid force, then the choke body may move toward the restrictor body, or uphole. As the fluid properties of the drilling fluid change, the balance between the fluid force and the resilient force may change. This may move the choke body toward or away from the restrictor body. Moving the choke body relative to the restrictor body will change the restrictor offset, thereby changing the pressure differential uphole of the pressure control valve. The resilient member may be sized such that a change in the restrictor offset as a result of changing drilling parameters may result in a pressure differential that stays within a specified range. In this manner, the pressure control valve may maintain a consistent range of pressure differentials for various fluid properties. In some embodiments, regardless of the source of the fluid flow (e.g., from the surface, from the annulus, from a hydraulic pump downhole), it is the pressure differential across the pressure control valve that generates the force that pushes against the resilient member to cause the relative movement of the choke body and/or the restrictor body with respect to each other.

In a conventional nozzle, when a fluid property is changed, such as increased fluid density and/or an increased volumetric flow rate, the pressure differential uphole of the nozzle increases. By moving the choke body away from the restrictor body, the increase in the pressure differential uphole of the pressure control valve may be reduced or eliminated. Similarly, a decreased fluid density and/or a decreased volumetric flow rate may decrease the differential pressure differential uphole of the nozzle. By moving the choke body toward the restrictor body, the decrease in the pressure differential may be reduced or eliminated. This may allow for a greater range of fluid properties to be used while operating the downhole tool within a set pressure range, which may increase the drilling penetration rate, decrease the drilling cost per foot, improve wellbore accuracy, or combinations of the foregoing.

In some embodiments, using the resilient member to urge the choke body toward the restrictor body may be a passive pressure control valve. In other words, the pressure control valve may automatically maintain the pressure differential uphole of the pressure control valve within a pressure differential range based on the drilling fluid properties. The pressure differential range for a given set of fluid properties may be selected based on the spring force applied by the resilient member. In some embodiments, the resilient member may include any resilient member, including a coil spring, one or more Belleville washers, a wave spring, a hydraulic piston, a pneumatic piston, an elastomeric material, a compressible material, any other resilient material, or combinations thereof.

In some embodiments, the choke body may be actively actuated. In place of, or in addition to, the resilient member, the choke body may be moved by a linear actuator, a solenoid, a voice coil, a hydraulic piston, other actuator, or combinations of thereof. In some embodiments, the choke body may be movable between only two positions (e.g., a high pressure position and a low pressure position). In some embodiments, the actuator may be a bi-stable actuator, such that power is not required to maintain either the high pressure position or the now pressure position. In some embodiments, the actuator may be continuously activated when the actuator is in one of the high pressure position or the low pressure position. A choke body that is actuatable between only two positions may be simple to install and operate, and may be reliable while operating.

In some embodiments, the choke body may be movable in a range between the high pressure position and the low pressure position. For example, the choke body may be set or held at any position between the fully actuated and fully de-actuated positions. This may allow the operator to set the pressure differential within a large pressure differential range. This may increase the workable range of fluid properties for drilling the wellbore, including fluid density, volumetric flow rate, and so forth.

In some embodiments, the choke body may include both a resilient member and an electronic actuator. For example, the desirable pressure range for drilling a curve (e.g., a dogleg) may be different from the desirable pressure range for drilling straight (horizontally, vertically, or any constant azimuth and inclination). The base of the resilient member may be movable between two or more positions with an actuator. When the base position is moved closer to the restrictor body with the actuator, then the pressure differential range from hydraulic variations pushing on the choke body and resisted by the resilient member may be increased. Similarly, when the base position is moved further from the restrictor body with the actuator, then the pressure differential range from hydraulic variations pushing on the choke body and resisted by the resilient member may be decreased.

In some embodiments, the choke body may remain fixed relative to the housing, and one or more resilient members may urge the restrictor body toward the choke body with a resilient force. As the fluid flow flows through the orifice, the fluid flow may exert a downhole-facing fluid force on the restrictor body. The fluid force may urge the restrictor body away from the choke body, or downhole. When the operator changes one or more fluid properties, the fluid force on the restrictor body may change as well. If the fluid force is greater than the resilient force, the restrictor body may move away from the choke body, or downhole. If the resilient force is greater than the fluid force, then the restrictor body may move toward the choke body, or uphole. As the fluid properties of the drilling fluid change, the balance of the fluid force and the resilient force may change. This may move the restrictor body toward or away from the choke body. Moving the restrictor body relative to the choke body will change the restrictor offset. The resilient member may be sized such that a change in the restrictor offset as a result of changing drilling parameters may result in a pressure differential that stays within a specified range. In this manner, the pressure control valve may maintain a consistent range of pressure differentials for various fluid properties.

Furthermore, by moving the restrictor body away from the choke body, the change in the pressure differential due to a change in a fluid property may be reduced or eliminated. This may allow for a greater range of fluid properties to be used while operating the downhole tool within a set pressure range, which may increase the drilling penetration rate, decrease the drilling cost per foot, improve wellbore accuracy, or combinations of the foregoing.

In some embodiments, the restrictor body may be passively activated, such as with the resilient member. In some embodiments, the restrictor body may be actively actuated. In place of, or in addition to, the resilient member, the restrictor body may be moved by a linear actuator, a solenoid, a voice coil, a hydraulic piston, other actuator, or combinations of thereof. In some embodiments, the restrictor body may be movable between only two positions (e.g., a high pressure position and a low pressure position). In some embodiments, the actuator may be a bi-stable actuator, such that power is not required to maintain either the high pressure position or the now pressure position. In some embodiments, the actuator may be continuously activated when the actuator is in one of the high pressure position or the low pressure position. A restrictor body that is actuatable between only two positions may be simple to install and operate, and may be reliable while operating.

In some embodiments, the restrictor body may be movable in a range between the high pressure position and the low pressure position. For example, the restrictor body may be at any position between the fully actuated and fully de-actuated positions. This may allow the operator to set the pressure differential within a large pressure differential range. This may increase the workable range of fluid properties for drilling the wellbore, including fluid density, volumetric flow rate, and so forth. In some embodiments, the restrictor body may include both a resilient member and an electronic actuator.

In some embodiments, the pressure control valve may include a rotor and a stator. The stator may be connected to the housing, and include one or more stator ports. The rotor may be located immediately uphole or downhole of the stator, and may include one or more restrictor lobes. The rotor may rotate relative to the stator. As the rotor rotates relative to the stator, the one or more rotor lobes may occlude or block the one or more stator ports (e.g., in a closed position). This may increase the pressure differential uphole of the pressure control valve.

As the rotor further rotates (either in the same direction or in the opposite direction) relative to the stator, the rotor lobes may uncover the stator ports (e.g., in an open position). This may decrease the pressure differential of the pressure control valve. In some embodiments, the stator port may be the same size or smaller than the rotor lobe. Therefore, as the rotor rotates, the stator port may become fully covered or occluded in the closed position. In some embodiments, the stator port may be larger than the rotor lobe. In this manner, at least a portion of the fluid flow may flow through the stator port, even in the closed position when occluded by the rotor lobe. In at least one embodiment, a rotary valve may allow for a fine control of the occlusion of the stator ports. This may allow for a fine control over the pressure differential uphole of the pressure control valve.

In some embodiments, the orifice may include a variable diameter. For example, the choke body may include an actuator that may change the diameter of the orifice between an open position (e.g., a larger orifice diameter) and a closed position (e.g., a smaller orifice diameter). In the open position, the pressure differential uphole of the choke body may be increased, and in the closed position, the pressure differential uphole of the choke body may be decreased.

The choke body may change the orifice diameter, in some embodiments, using a shutter valve. The shutter valve may include a plurality of valve members arranged circumferentially around the orifice. Each valve member may be connected to the neighboring valve members with a sliding connection. Each valve member may have a base connected to the choke body and a tip oriented toward the orifice (e.g., a generally triangular shape). When the valve members are extended (e.g., in a closed position), the tip of the valve members may be extended into the orifice. The sides of the valve members may slide alongside each other and the orifice diameter may be reduced. When the valve members are retracted (e.g., in an open position), the tip of the valve members may be retracted toward the choke body. The sides of the valve members may slide alongside each other, and the orifice diameter may be increased.

In some embodiments, each valve member may be moved by an individual actuator. In some embodiments, the choke body may include more valve members than actuators, and the motion of the actuated valve members may move the non-actuated valve members. In some embodiments, the valve members may be extended sufficient to completely close the shutter valve. In some embodiments, at their fullest extension, the valve members may leave a minimum orifice diameter, such that a portion of the fluid flow may flow through the orifice in the closed position.

A shutter valve may allow for fine control of the orifice diameter. This may allow for a fine control of the pressure differential uphole of the choke body. Furthermore, because the orifice in the shutter valve is circular or approximately circular, and there is no restrictor in the flow path of the fluid flow, the shutter valve may be hydrodynamically favorable. Favorable hydrodynamic conditions may reduce wear on various components both uphole and downhole of the choke body, and may provide a consistent and predictable pressure differential at the downhole tool (e.g., the extendable pads).

In some embodiments, a pressure control valve may include a combination of the valves discussed herein. For example, a pressure control valve may include a choke body having a shutter valve and a variable orifice diameter, and may also include a variable restrictor offset (e.g., by moving either the choke body or the restrictor body). In other examples, the restrictor body may be both rotatable and have a variable restrictor offset. In still other examples, the restrictor body may be rotatable, the restrictor offset may be variable, and the orifice diameter may be variable. These combinations may allow for an even greater control over the pressure differential uphole of the pressure control valve.

In some embodiments, a method for controlling pressure at a downhole tool includes flowing a fluid flow through a bore in a housing. The bore includes a pressure control valve. The fluid flow has a first drilling property and a first pressure differential above the pressure control valve. The method includes diverting a portion of the fluid flow to the downhole tool uphole of the pressure control valve. The downhole tool may include any downhole tool operable or influenced by fluid pressure. for example, the downhole tool may be an expandable piston on a rotary steerable system (RSS). In other examples, the downhole tool may be a reamer or other expandable tool In some examples, the downhole tool may be power generation system.

The method may include changing the first drilling property to a second drilling property. For example, the drilling property may include any fluid property, including fluid density, volumetric flow rate, and so forth. The method may further include adjusting a flow restrictor of the pressure control valve with an actuator in response to changing the first drilling property to the second drilling property. Adjusting the flow restrictor may maintain or substantially maintain the first pressure differential above the pressure control valve.

Adjusting the flow restrictor may further include changing the coefficient of discharge for the flow restrictor. For example, the coefficient of discharge may be directly related to how close a restrictor body is located relative to a choke body or an orifice. By moving the restrictor body closer to or further from the choke body, the coefficient of discharge may be changed.

Adjusting the flow restrictor may further include actively adjusting the flow restrictor. For example, the drilling property may be measured with a sensor, and the actuator may adjust the flow restrictor based on the measured drilling property. In some embodiments, one or more sensors may measure any downhole drilling parameter, including wellbore conditions, such as temperature, vibration, gamma ray measurements, azimuth, inclination, other downhole drilling parameters, or combinations thereof. The flow restrictor may be changed based on any measured or inferred drilling parameter to optimize the pressure differential for specific drilling conditions.

Referring now to the figures, FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
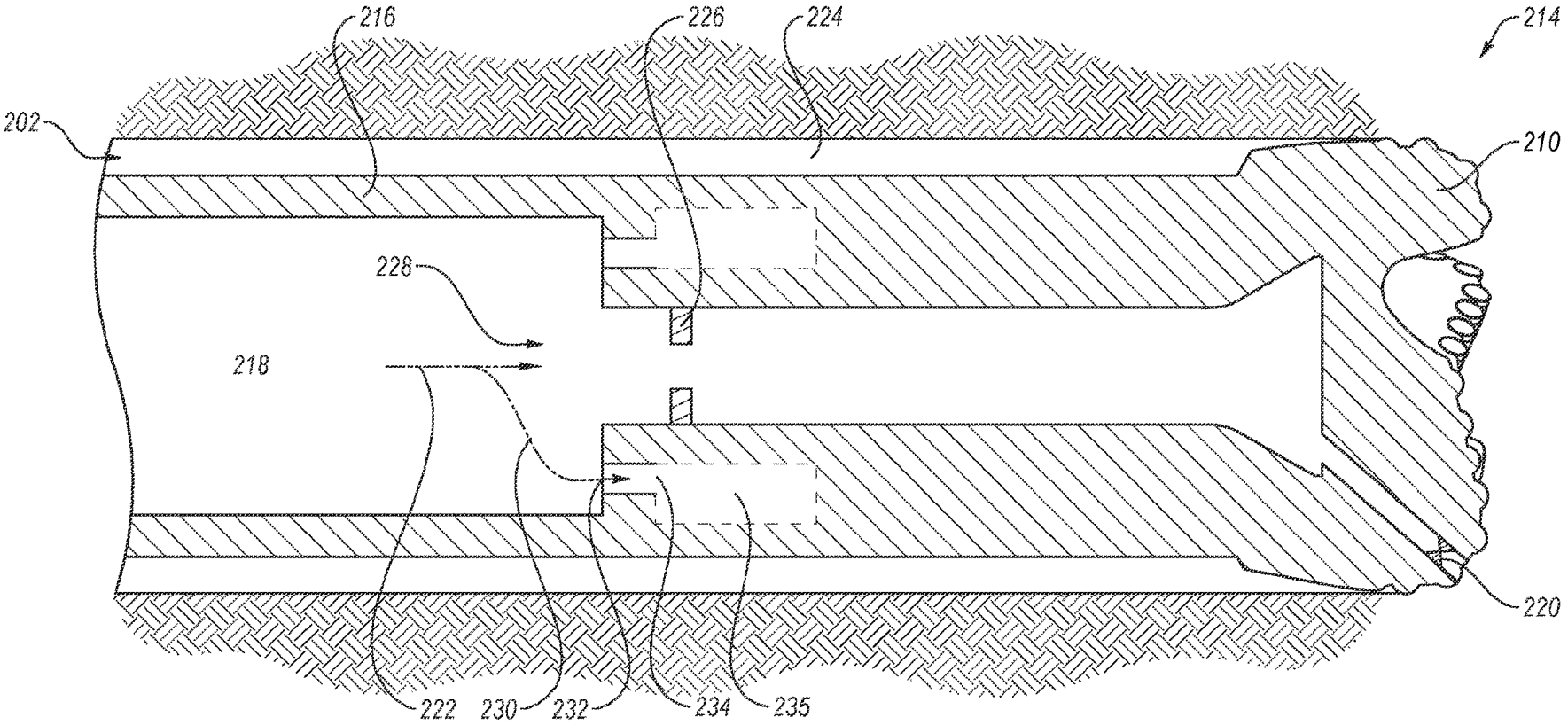
FIG. 2 is a cross-sectional view of a representation of a downhole flow system, according to at least one embodiment of the present disclosure.

FIG. 2 is a cross-sectional view of a representation of a downhole flow system 214, according to at least one embodiment of the present disclosure. The downhole steering system 214 includes a housing 216 connected to a bit 210. A bore 218 runs through the housing 216 to the bit 210. A fluid flow 222 passes through the bore 218 until it exits the bit at a bit nozzle 220. The fluid flow 222 has a pressure differential between the bore 218 and the annulus 224 of the wellbore 202. The pressure differential may be dependent on, at least in part, the diameter of the bit nozzle 220.

At least a portion 230 of the fluid flow 222 passes into a port 232 in the housing 216. The portion 230 of the fluid flow 222 flows into a fluid path 234 to one or more downhole tools 235. When the pressure differential is sufficient, the one or more downhole tools 235 may be actuated.

A pressure control valve 226 is located in the bore 218 in the path of the fluid flow 222. In the embodiment shown, the pressure control valve 226 extends across an entirety of a diameter of the bore 218. The pressure control valve 226 is located downhole (e.g., downstream in the fluid flow 222) of the port 232 to the downhole tool 235. The pressure control valve 226 includes a restrictor (examples of which are shown in FIGS. 4-1 through 5-2) that varies the pressure differential uphole 228 (e.g., upstream in the fluid flow 222) of the pressure control valve 226. This may allow the operator, in at least one embodiment, to customize the amount of force applied to the wellbore wall 238 based on wellbore properties, such as the geological formation, drilling conditions, trilling trajectory, or combinations of the foregoing.

Figure 3:
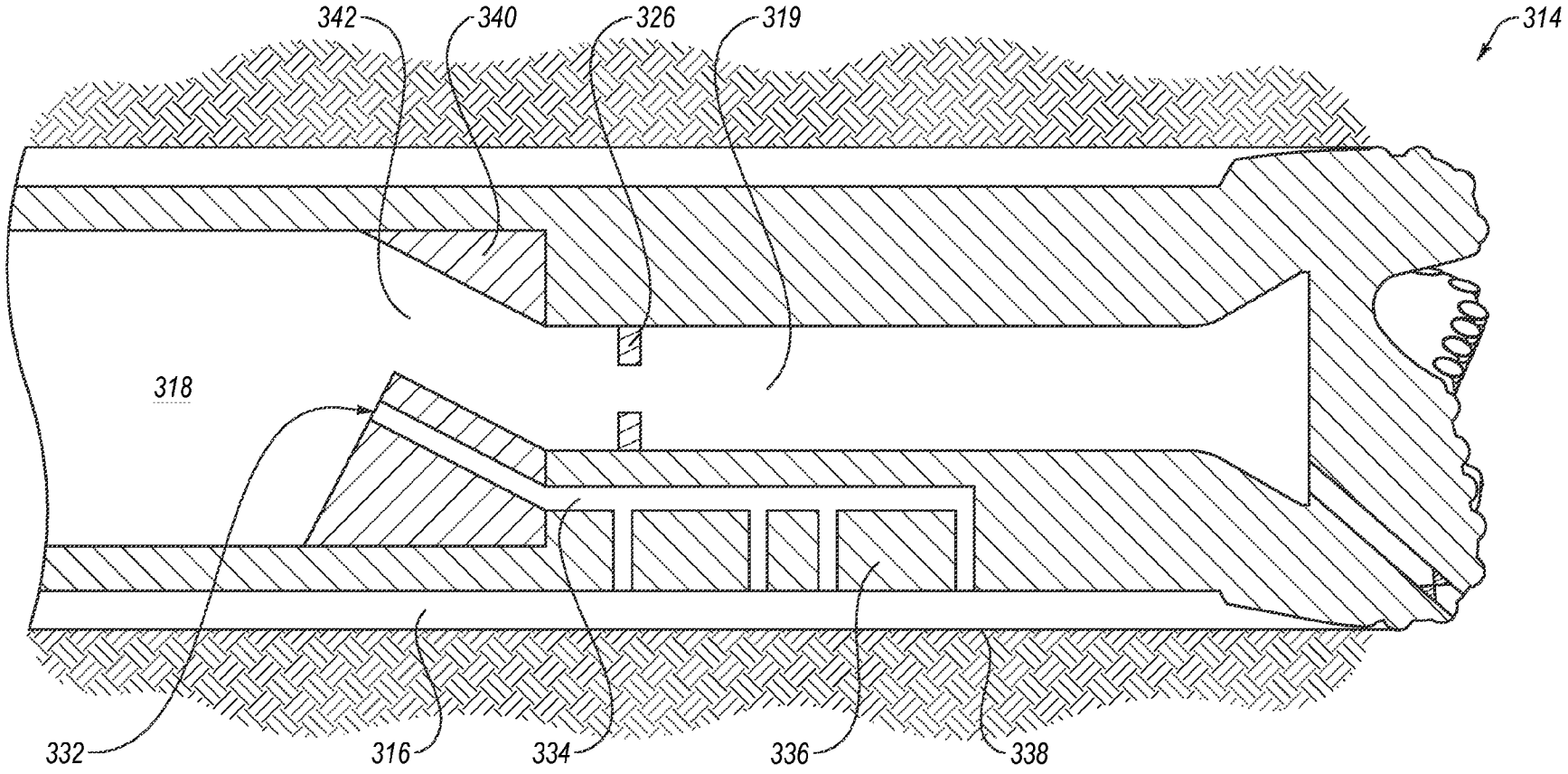
FIG. 3 is a cross-sectional view of another representation of a downhole steering system, according to at least one embodiment of the present disclosure.

FIG. 3 is a cross-sectional view of a representation of a downhole steering system 314, according to at least one embodiment of the present disclosure. A pressure control valve 326 is located in a bore 318 downhole of a flow diverter 340. The flow diverter 340 includes a port 332 that leads to a piston fluid path 334 and the expandable pistons 336. A main channel 342 in the flow diverter 340 directs flow into a lower bore 319. The pressure control valve 326 is located in the lower bore 319. The flow diverter 340 may help to provide a smooth transition between the bore 318 and the piston fluid path 334 and the lower bore 319. This may reduce erosion of the housing 316. Furthermore, the pressure control valve 326 may vary the pressure differential uphole of the pressure control valve 326. Therefore, by adjusting the pressure control valve 326, the pressure differential across the expandable pistons 236 may be changed. This may reduce the force of the expandable pistons 336 against the borehole wall 338. This may help to reduce erosion of the borehole wall 338, and may allow the operator to adjust the force with which the expandable pistons 336 push against the borehole wall 338.

Figures 1, 4:
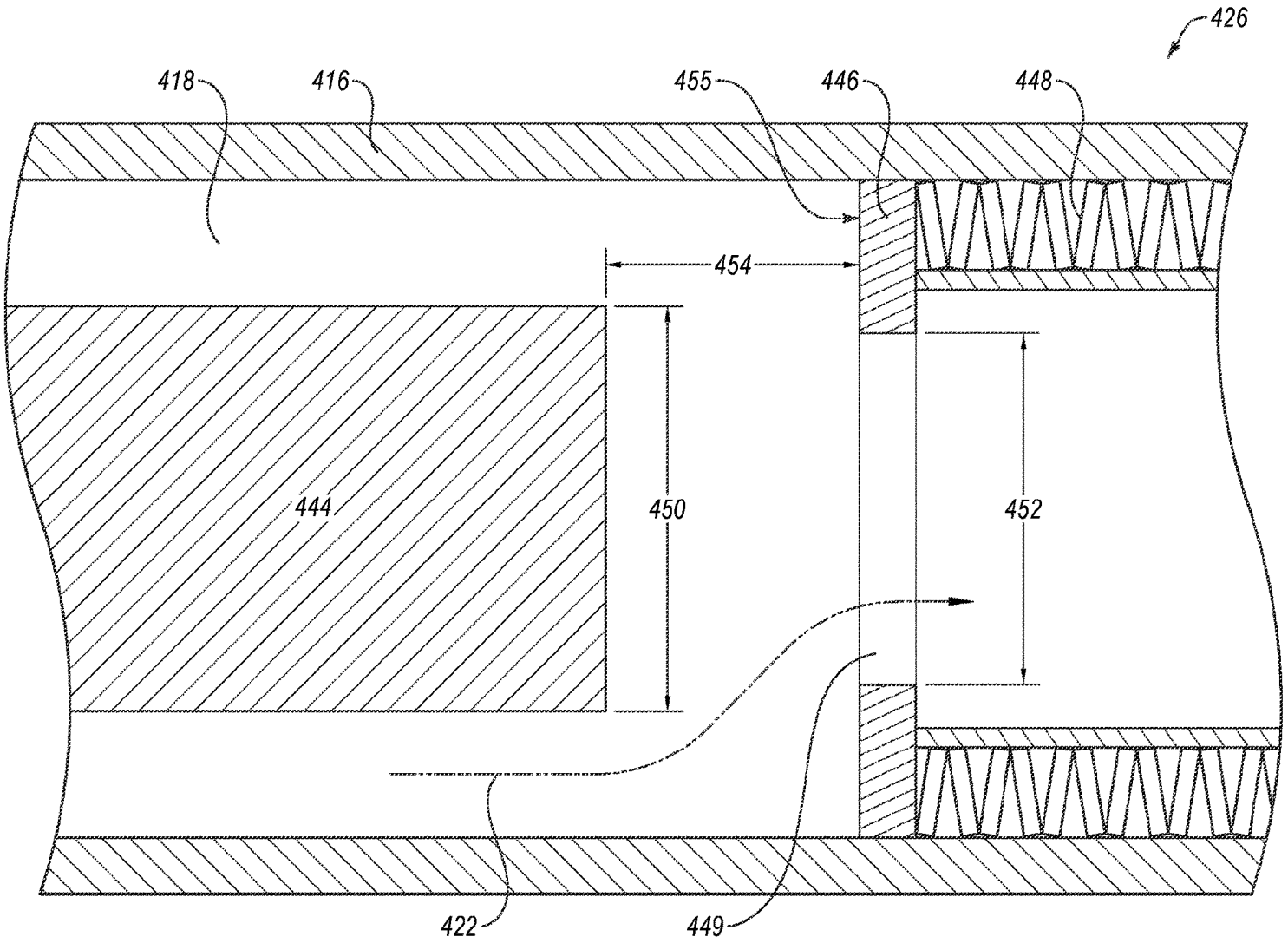
Figures 2, 4:
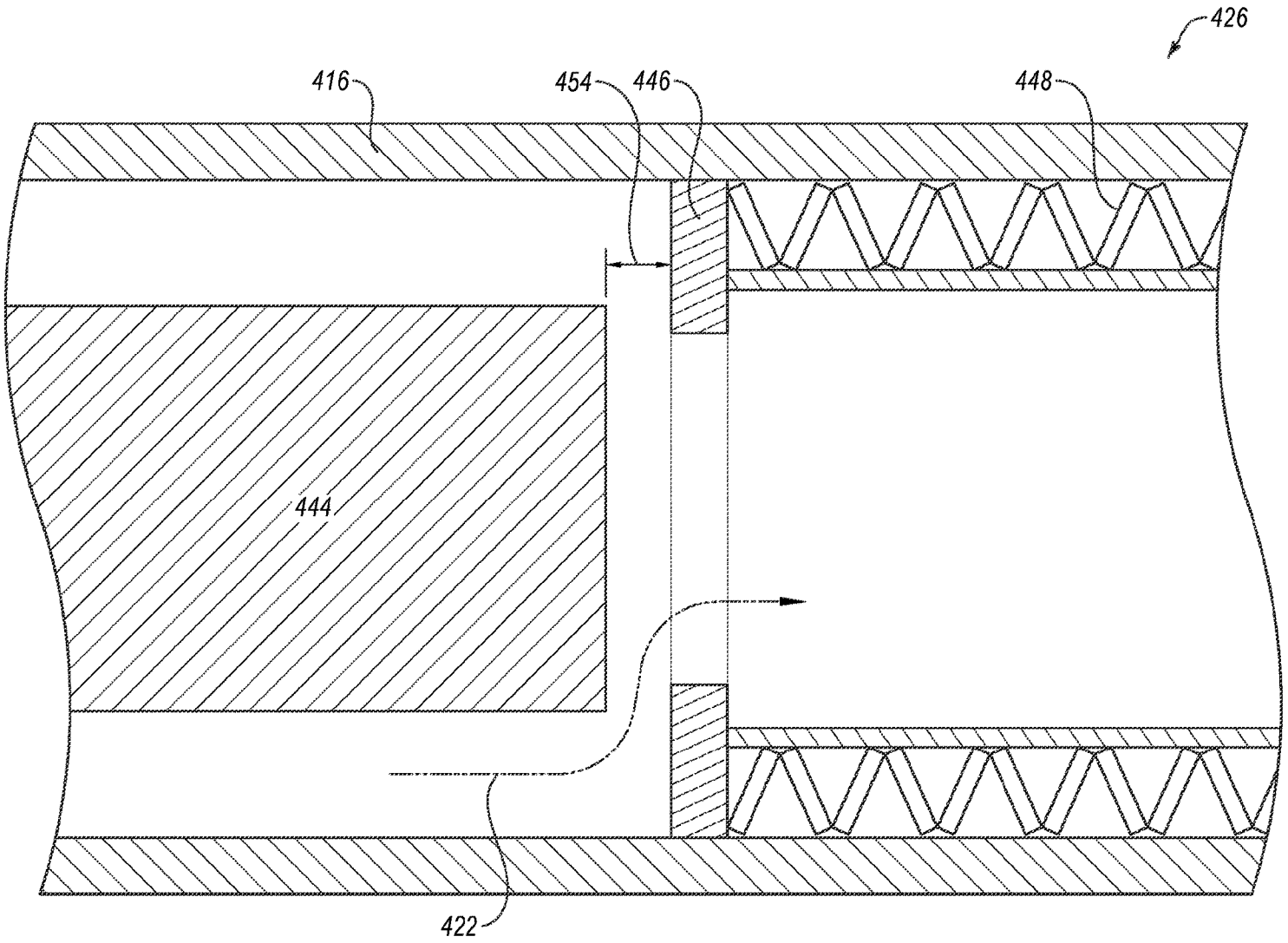

FIG. 4-1 is a representation of a pressure control valve 426, according to at least one embodiment of the present disclosure. The pressure control valve 426 includes a restrictor body 444 in a bore 418 of a housing 416. In the embodiment shown, the restrictor body 444 is fixed to the housing 416 (e.g., does not move longitudinally relative to the housing 416). A choke body 446 is movable relative to the housing 416 and the restrictor body 444. A resilient member 448 urges the choke body 446 toward the restrictor body 444. A fluid flow 422 flows around the restrictor body 444 and through an orifice 449 in the choke body 446.

The area of the orifice is dependent upon the flow rate, the coefficient of discharge, the fluid density, and the desired differential pressure drop across the orifice. The area of the orifice 449 may therefore be approximated as shown in Eq. (2) (reproduced below):

$$A = \frac{Q}{C_d}\sqrt{\frac{\rho}{2\Delta p}} \tag{2}$$

where A is the area of the orifice 449 (e.g., in inches squared), Q is the volumetric fluid flow for the downhole tool (e.g., U.S. Gallons per minute), Ca is the coefficient of discharge for the orifice 449, p is the fluid density, and Δp is the desired change in pressure differential.

By solving Eq. (2) for Δp, the pressure differential may be modeled for a set orifice area, as shown in Eq. (3) (reproduced below:

$$\Delta p = \frac{\rho}{2}\left(\frac{Q}{C_d A}\right)^2 \tag{3}$$

Thus, the change in the pressure differential across the orifice 449 is dependent upon the fluid density, the volumetric flow rate, the coefficient of discharge, and the area of the orifice. During downhole drilling operations, the fluid density and/or the volumetric flow rate may be changed. This will change the pressure differential. To maintain a constant pressure differential, or to maintain the pressure differential within a set range, the coefficient of discharge and/or the area of the orifice 449 may be changed. For example, for an increased fluid density or volumetric flow rate, to maintain a constant pressure differential, the coefficient of discharge and/or the area of the orifice 449 may be reduced. Similarly, for a decreased fluid density or volumetric flow rate, to maintain a constant pressure differential, the coefficient of discharge and/or the area of the orifice 449 may be increased.

The restrictor body 444 has a restrictor diameter 450, and the orifice 449 has an orifice diameter 452. The orifice diameter 452 is less than a bore diameter of the bore. In some embodiments, the restrictor diameter 450 is sized relative to the orifice diameter 452 with a restrictor diameter ratio. A larger restrictor diameter ratio may provide a greater increase in pressure differential uphole of the pressure control valve 426 (e.g., at the port 232 of FIG. 2). In some embodiments, the restrictor diameter ratio may be in a range having an upper value, a lower value, or upper and lower values including any of 50%, 60%, 70%, 80%, 90%, 100%, 110%, 120%, 130%, 140%, 150%, or any value therebetween. For example, the restrictor diameter ratio may be greater than 50%. In another example, the restrictor diameter ratio may be less than 150%. In yet other examples, the restrictor diameter ratio may be any value in a range between 50% and 150%. In some embodiments, it may be critical that the restrictor diameter ratio is greater than 100% to sufficiently increase the pressure differential uphole of the pressure control valve.

The restrictor body 444 is offset from the orifice 449 (e.g., the choke body 446) with a restrictor offset 454. The restrictor offset 454 is an offset percentage of the orifice diameter 452. A smaller restrictor offset 454 may decrease the coefficient of discharge, thereby increasing the pressure differential uphole of the pressure control valve 426. Similarly, a larger restrictor offset may increase the coefficient of discharge, thereby decreasing the pressure differential uphole of the pressure control valve. In some embodiments, the offset percentage may be in a range having an upper value, a lower value, or upper and lower values including any of 1%, 5%, 10%, 15%, 20%, 25%, 30%, 40%, 50%, 60%, 70%, 80%, 90%, 100%, or any value therebetween. For example, the offset percentage may be greater than 1%. In another example, the offset percentage may be less than 100%. In yet other examples, the offset percentage may be any value in a range between 1% and 100%. In some embodiments, the restrictor body 444 may contact the choke body (i.e., a restrictor offset of 0 or an orifice diameter percentage of 0%). When the restrictor offset equals 0, a minimum volumetric flow rate must be reached before flow begins to flow through the orifice. In some embodiments, the restrictor body 444 may be located further from the orifice 449 or the choke body 446 than a offset percentage of 100%. In some embodiments, it may be critical that the offset percentage is less than 10% to sufficiently increase the pressure differential uphole of the pressure control valve. In some embodiments, the restrictor offset 454 may be non-zero. In other words, at least a portion of the fluid flow 422 may always flow through the orifice 449, or there may permanently be space between the restrictor body 444 and the choke body 446. At full extension, the choke body 446 may not contact the restrictor body 444. This may allow at least some fluid to flow through the pressure control valve 426 even at low volumetric flow rates.

The fluid flow 422 pushes against the uphole surface 455 of the choke body 446. In the view shown in FIG. 4-1, the fluid pressure force from the fluid flow 422 has at least partially overcome a resilient force from the resilient member 448. Therefore, in the view shown, the pressure control valve 426 is in an open position. In other words, the choke body 446 has slid down the housing 416 away from the restrictor body 444. This may reduce the pressure differential uphole of the pressure control valve 426, or reduce the effects of a change in a drilling fluid parameter such as increased drilling fluid density, increased volumetric flow rate, another change in a drilling fluid parameter, or combinations thereof.

FIG. 4-2 is a representation of the pressure control valve 426 of FIG. 4-1 in a closed position. In the position shown, a change in a drilling fluid property of the fluid flow 422, such as decreased drilling fluid density, decreased volumetric flow rate, another fluid property, or combinations thereof, has reduced the fluid pressure force on the choke body 446. Therefore, the force from the resilient member 448 has at least partially overcome the fluid pressure force from the fluid flow 422. The resilient member shown is a stack of disc springs (e.g., Belleville washers).

The force from the resilient member 448 has slid the choke body 446 uphole along the housing 416. In this manner, the restrictor offset 454 between the restrictor body 444 and the choke body 446 has decreased. This will increase the pressure differential uphole of the pressure control valve 426, or reduce the effects of the change in drilling fluid parameter. In this manner, the pressure differential uphole of the pressure control valve 426 may be maintained within a set pressure differential range, based on the resilient force applied by the resilient member. This increases the range of drilling fluid density and volumetric flow rate, in at least one embodiment, that may effectively be used when drilling a wellbore. In at least one embodiment, this improves penetration rates, reduces drilling costs per foot, improves the versatility of the drilling system, or combinations thereof.

The embodiment shown in FIG. 4-1 and FIG. 4-2 is an example of a passive pressure control valve 426. In other words, the resilient member 448 automatically adjusts the position of the choke body 446 (and therefore the restrictor offset 454) based on changes to one or more drilling fluid properties. A passive pressure control valve 426 may be easy to install and maintain, may be inexpensive to manufacture, and reliable downhole. This may save time and money in a drilling operation.

Figures 1, 5:
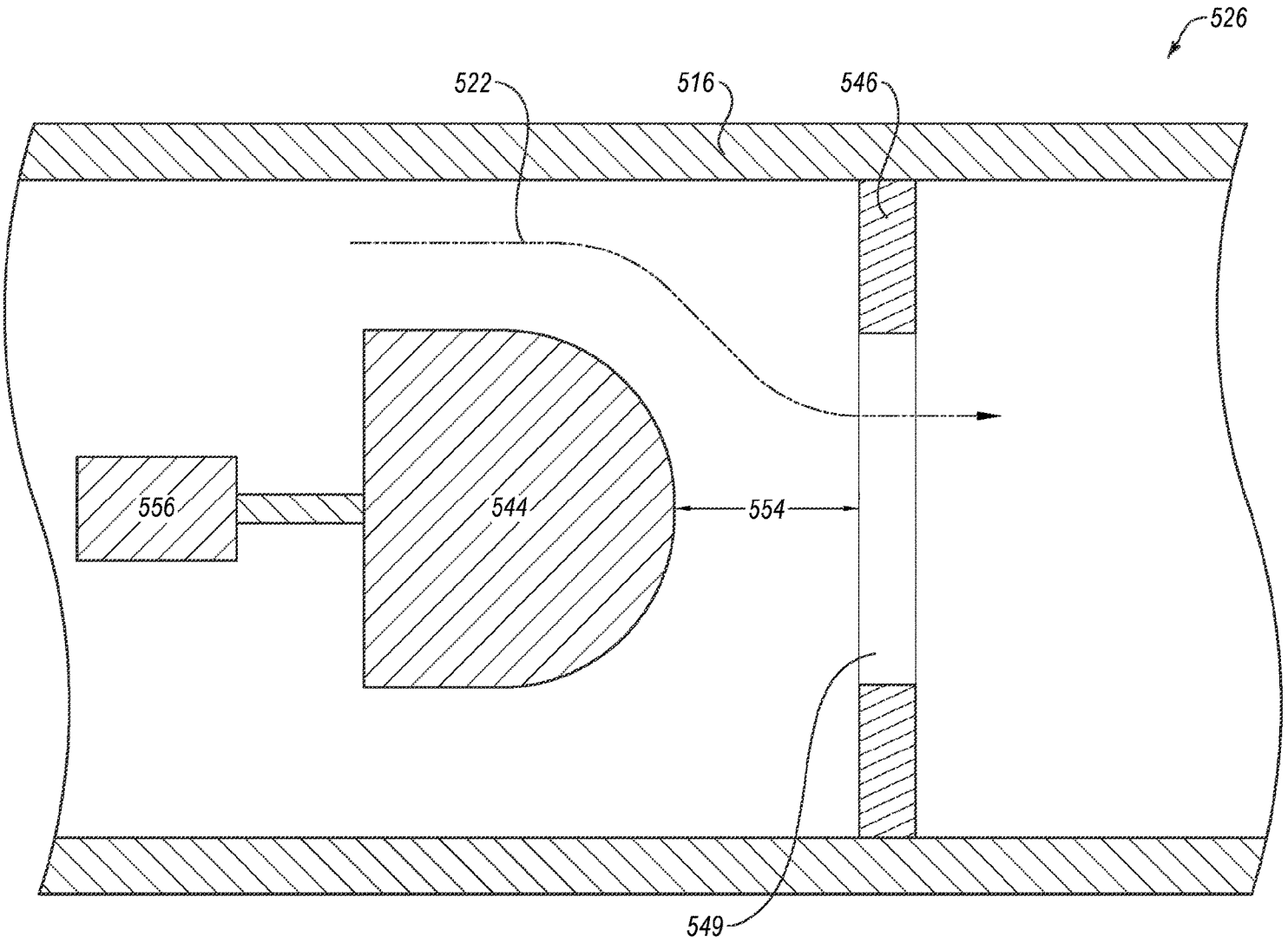
Figures 2, 5:
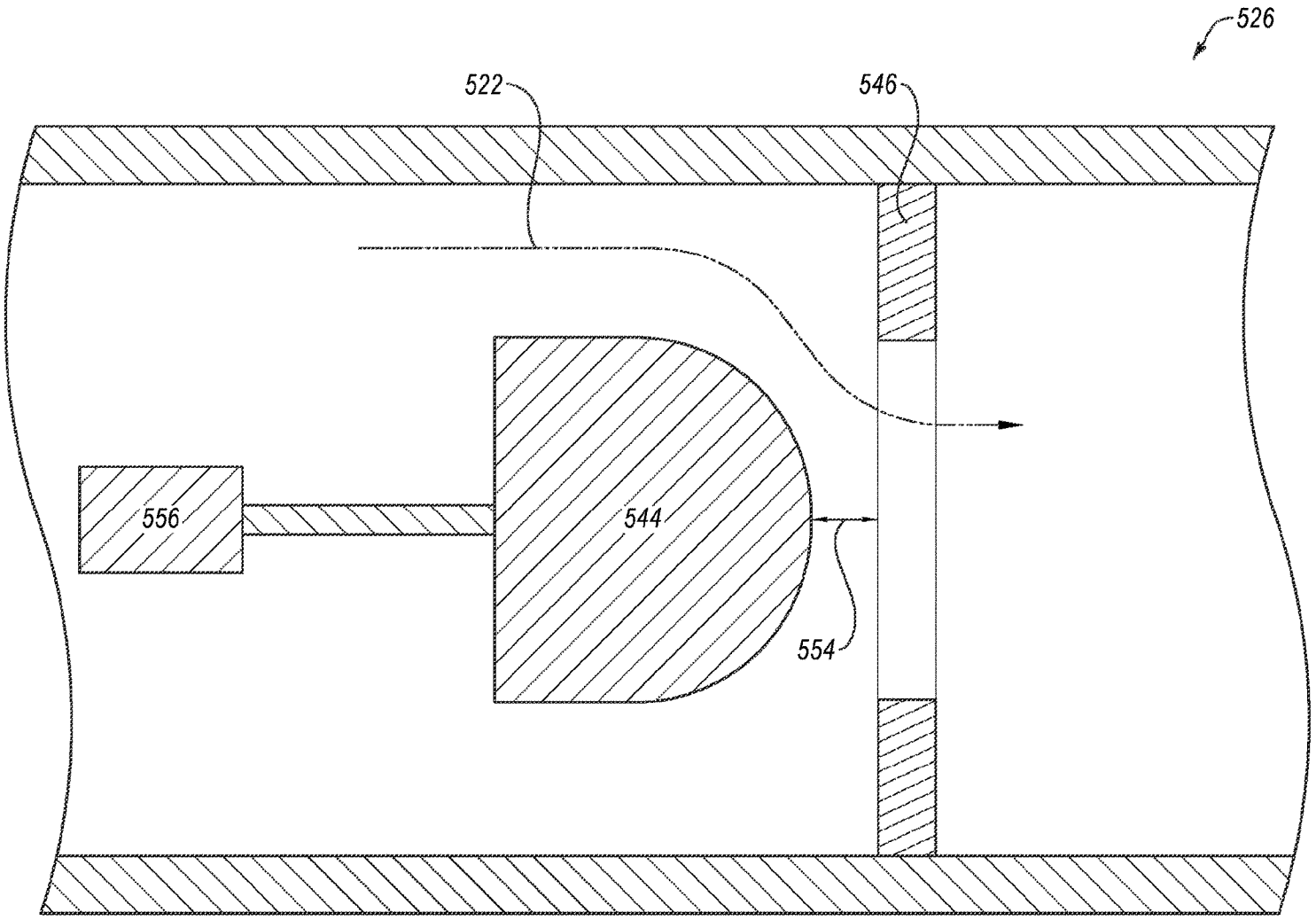

FIG. 5-1 is a cross-sectional view of a representation of a pressure control valve 526, according to at least one embodiment of the present disclosure. The pressure control valve 526 includes a choke body 546 fixed to a housing 516. A restrictor body 544 is movable relative to the housing 516 and the choke body 546. An actuator 556 is connected to the restrictor body 544. The actuator 556 moves the restrictor body 544 closer to and further away from the choke body 546. This may change the restrictor offset 554, which may change the pressure differential uphole of the pressure control valve 526.

In the view shown in FIG. 5-1, the pressure control valve 526 is shown in an open position. In this manner, the fluid flow 522 is less restricted through the orifice 549. This may reduce the pressure differential uphole of the pressure control valve 526.

FIG. 5-2 is a cross-sectional view of the pressure control valve 526 of FIG. 5-1, according to at least one embodiment of the present disclosure. In the view shown, the actuator 556 has extended the restrictor body 544 longitudinally toward the choke body 546. This has reduced the restrictor offset 554, thereby increasing the resistance to the fluid flow 522. This may increase the pressure differential uphole of the pressure control valve 526.

The embodiment shown in FIGS. 5-1 and 5-2 is an example of an active pressure control valve 526. An active pressure control valve 526 may change the position of the restrictor body 544 independent of the drilling fluid properties. This may allow an operator to increase or decrease the pressure differential uphole (e.g., at the port 232 to the expandable pistons 236 of FIG. 2) of the pressure control valve 526. In this manner, the operator may change the pressure differential based on any input, such as the formation characteristics, the wellbore trajectory, other input, or combinations of the foregoing. This may improve wellbore quality, improve wellbore trajectory, decrease wellbore costs, and increase the penetration rate.

Figures 1, 6:
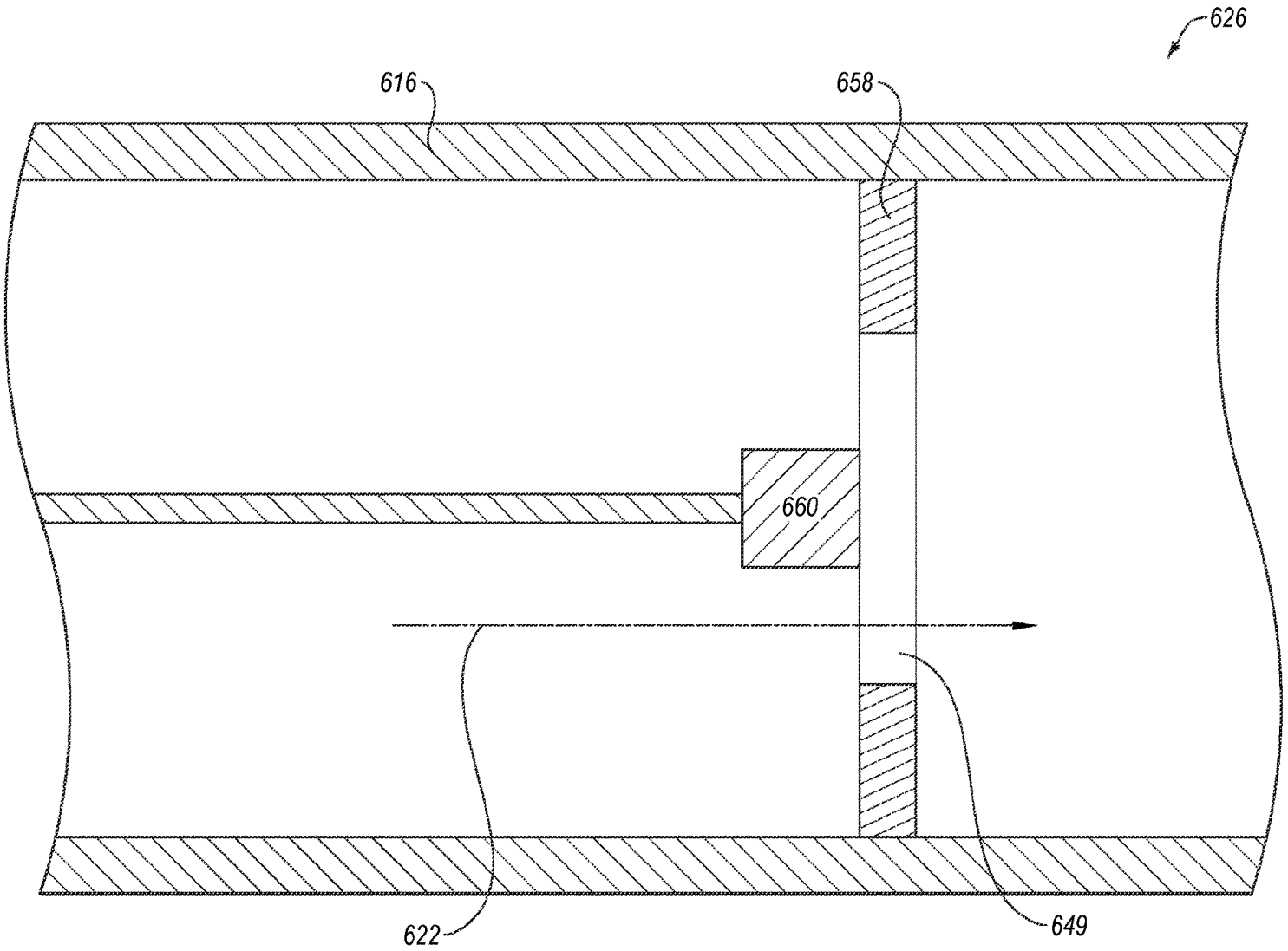
Figures 2, 6:
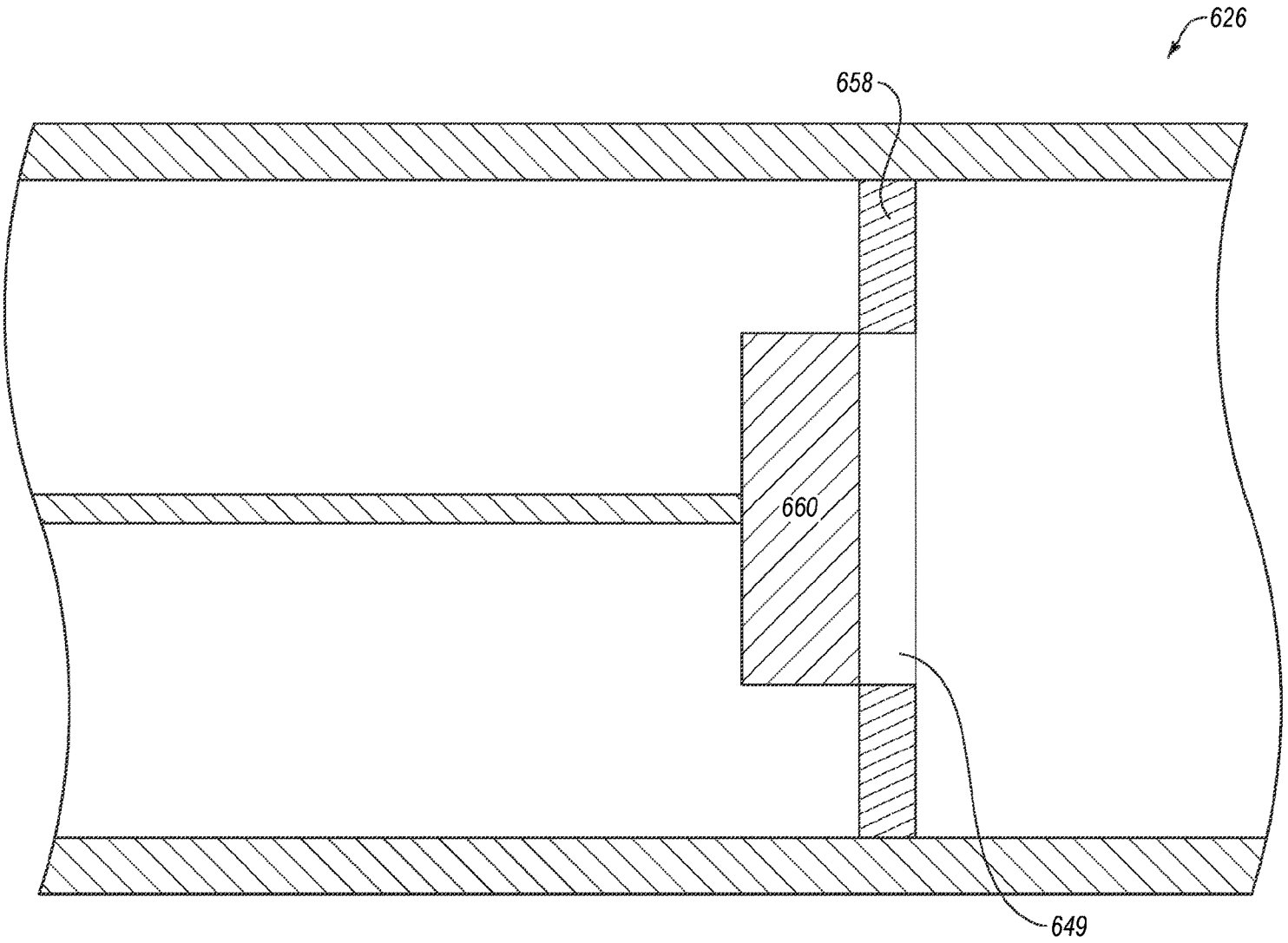
Figures 3, 6:
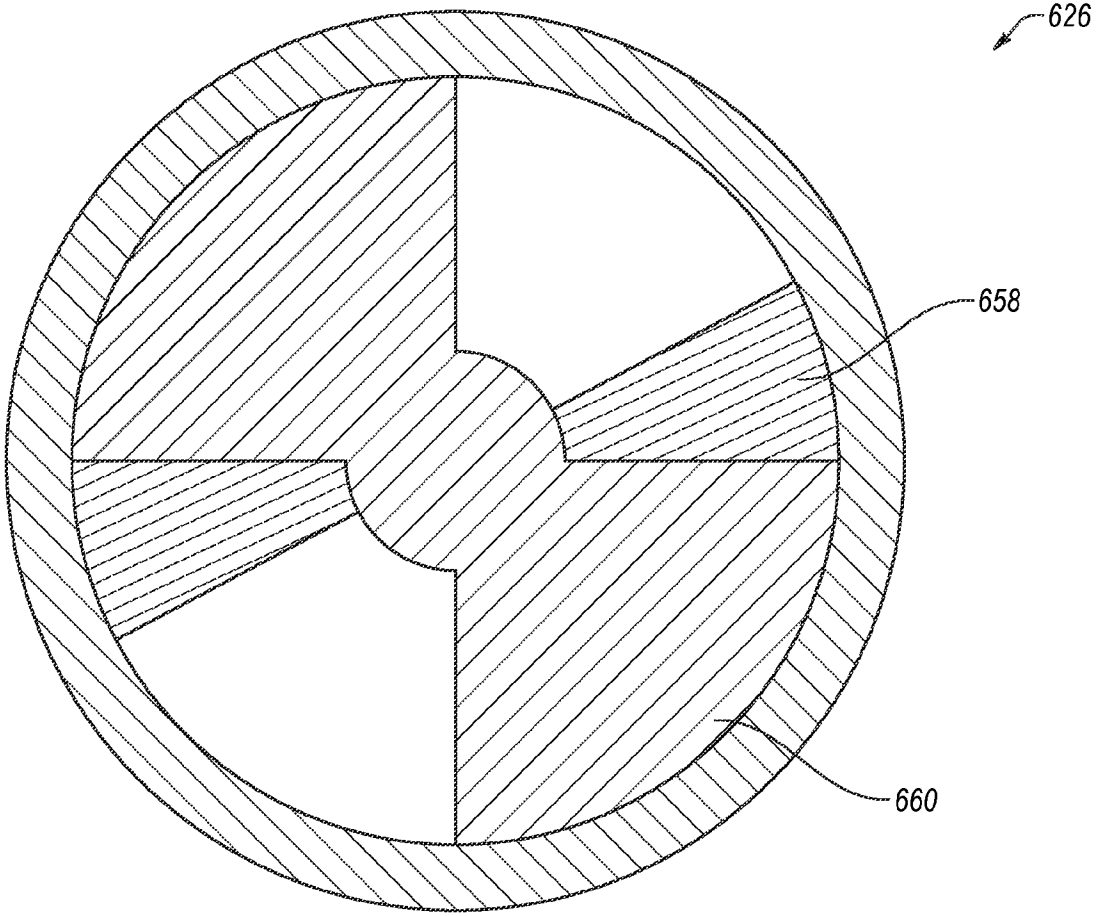

FIG. 6-1 is a longitudinal cross-sectional view of a representation of a pressure control valve 626, according to at least one embodiment of the present disclosure. The pressure control valve 626 includes a stator 658 connected to a housing 616. A rotor 660 is rotatable relative to the stator 658. In the view shown in FIG. 6-1, the rotor 660 is in an open position. In this position, the rotor 660 does not occlude or cover the orifice 649, or only partially occludes or covers the orifice 649. In this position, a fluid flow 622 is less restricted through the orifice 649, which results in a decreased pressure differential uphole of the pressure control valve 626.

FIG. 6-2 is a longitudinal cross-sectional view of the pressure control valve 626 of FIG. 6-1, according to at least one embodiment of the present disclosure. In the view shown, the rotor 660 is in a closed position, or the rotor 660 has blocked or occluded the orifice 649 in the stator 658. In this position, a fluid flow 622 is partially or fully blocked from traveling through the orifice 649. This results in an increased pressure differential uphole of the pressure control valve 629.

FIG. 6-3 is a transverse cross-sectional view of the pressure control valve 626 of FIG. 6-1, according to at least one embodiment of the present disclosure. In the view shown, the rotor 660 has partially occluded or blocked the orifice 649 (e.g., a port between stator 658 sections) of the stator 658. The embodiment shown in FIG. 6-1, FIG. 6-2, and FIG. 6-3 is an example of an active pressure control valve 626. An active pressure control valve 626 may change the position of the rotor 660 independent of the drilling fluid properties. This may allow an operator to increase or decrease the pressure differential uphole (e.g., at the port 232 to the expandable pistons 236 of FIG. 2) of the pressure control valve 626. Furthermore, as shown in FIG. 6-3, the rotor 660 is positionable at any position between fully open (e.g., with the orifice 649 fully uncovered) and fully closed (e.g., with the orifice 649 fully occluded or covered). This may allow a fine control over the pressure differential uphole of the pressure control valve 626. In this manner, the operator may change the pressure differential based on any input, such as the formation characteristics, the wellbore trajectory, other input, or combinations of the foregoing. This may improve wellbore quality, improve wellbore trajectory, decrease wellbore costs, and increase the penetration rate.

Figures 1, 7:
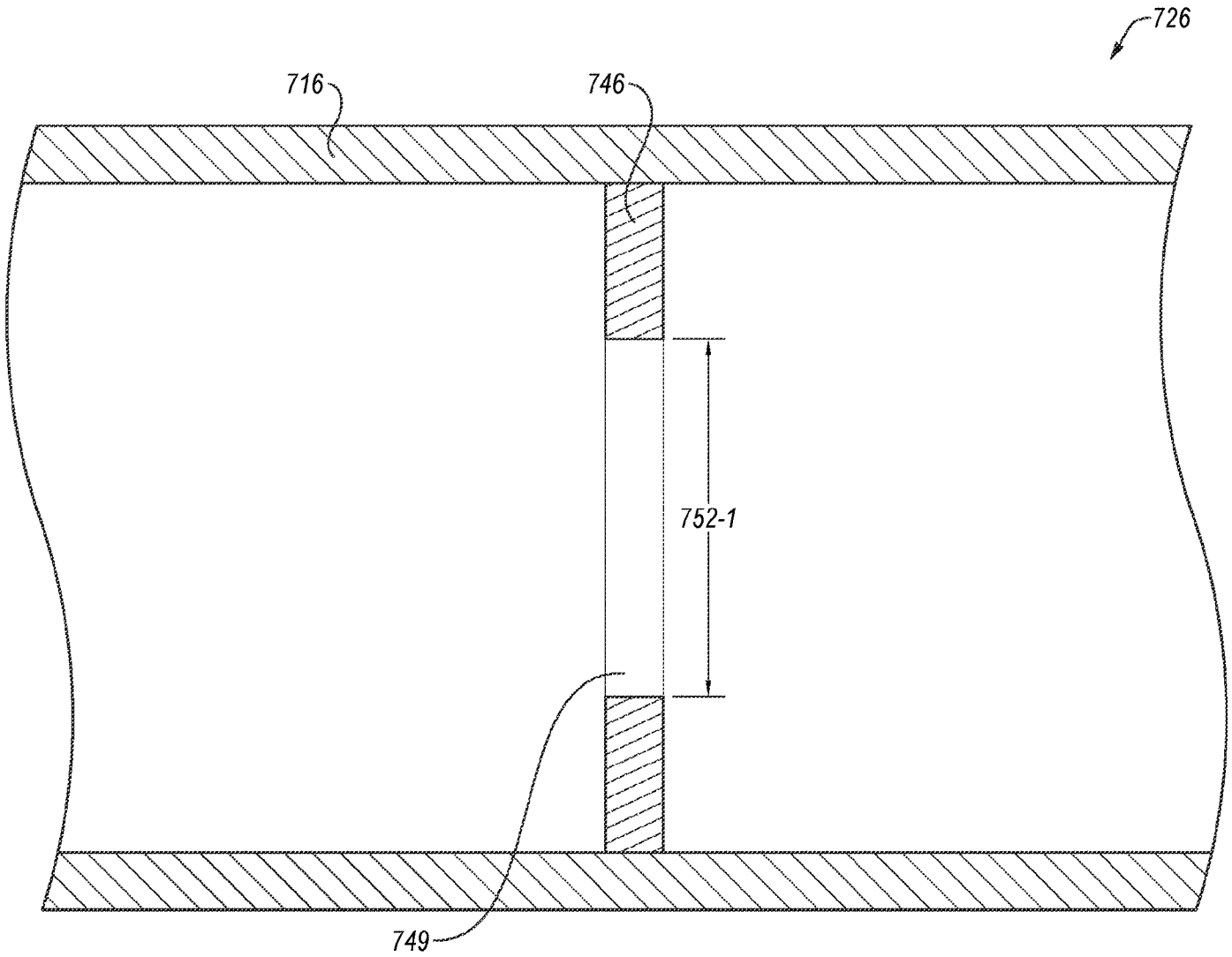
Figures 2, 7:
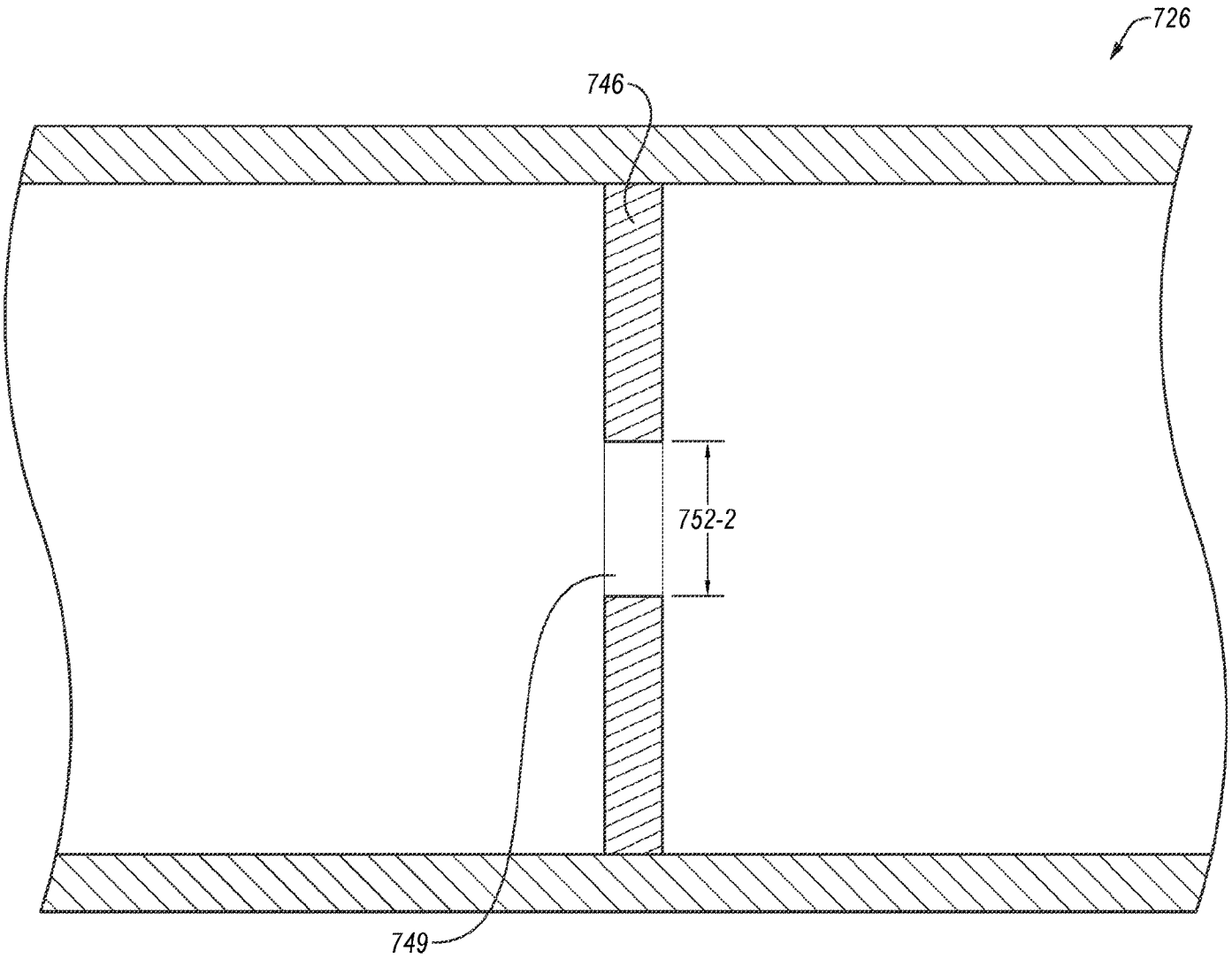
Figures 3, 7:
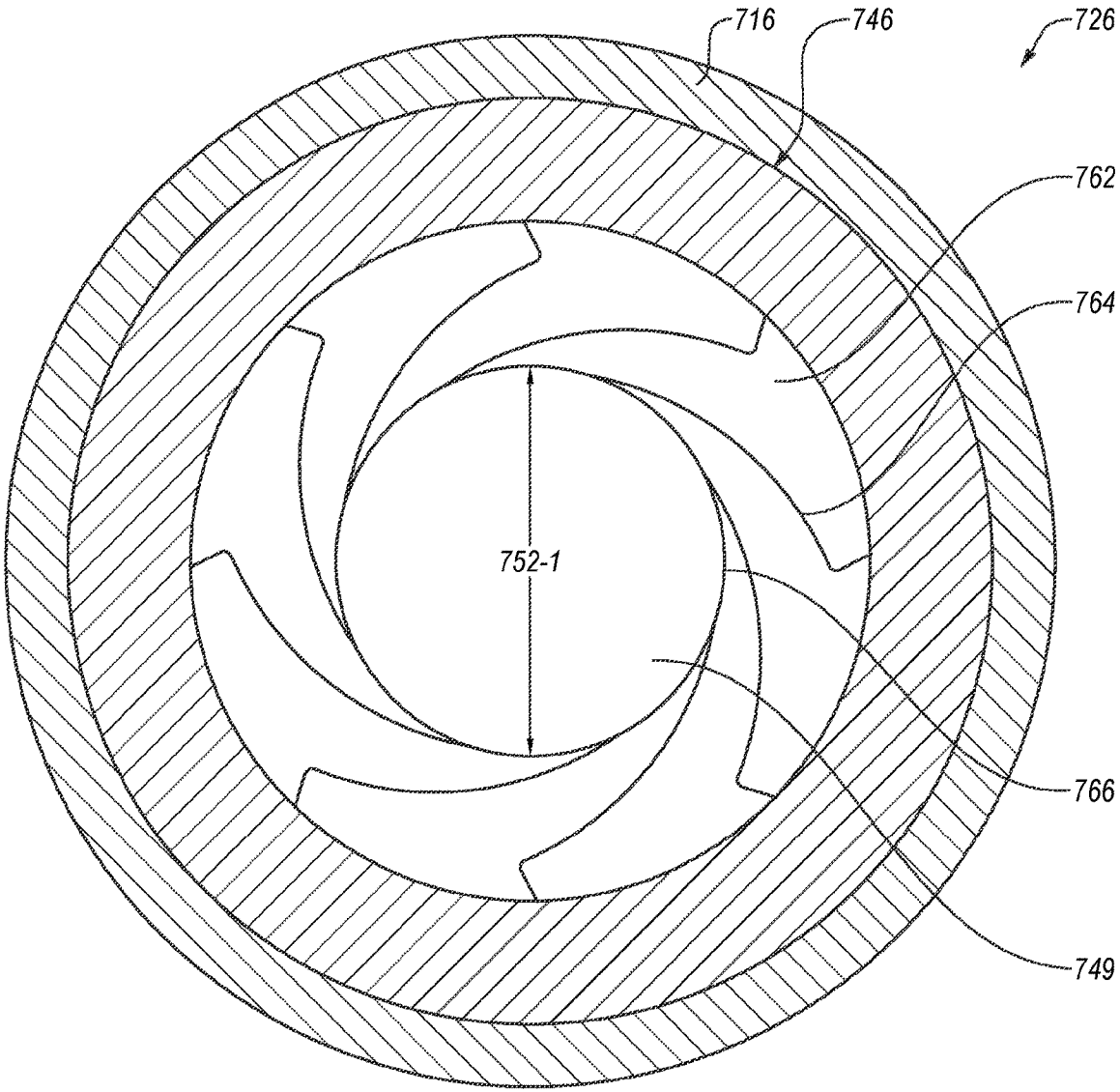
Figures 4, 7:
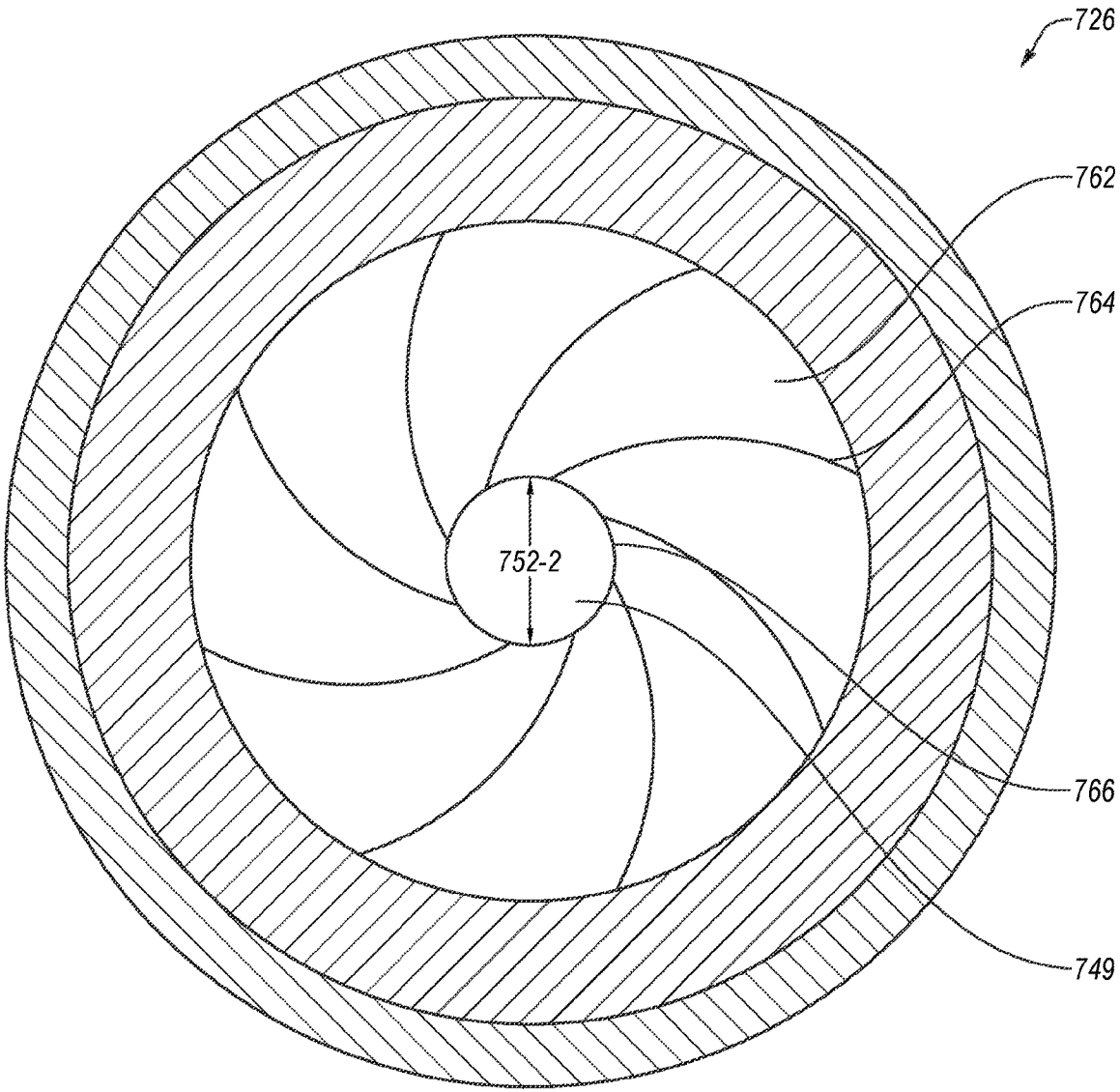

FIG. 7-1 is a longitudinal cross-sectional view of a pressure control valve 726, according to at least one embodiment of the present disclosure. The pressure control valve 726 includes a choke body 746 fixed to a housing 716. The choke body 746 includes an orifice 749 having an adjustable orifice diameter (collectively 752). In the view shown in FIG. 7-1, the pressure control valve 726 is in an open position, with the orifice 749 being opened with a first orifice diameter 752-1. In this position, the pressure differential uphole of the pressure control valve 726 is decreased.

FIG. 7-2 is a longitudinal cross-sectional view of a pressure control valve 726 in a closed position, according to at least one embodiment of the present disclosure. In the view shown, the choke body 746 has an orifice 749 having a second orifice diameter 752-2 that is smaller than the first orifice diameter 752-1 of FIG. 7-1. In this position, the pressure differential uphole of the pressure control valve 726 is increased.

FIG. 7-3 is a transverse cross-sectional view of the pressure control valve 726 of FIG. 7-1 in the open position, according to at least one embodiment of the present disclosure. The choke body 746 includes a plurality of valve members 762 arranged circumferentially around the orifice 749. Each valve member 762 is connected to its neighboring valve member 762 with a sliding connection 764. In the view shown, a tip 766 of each valve member 762 is extended in toward the housing 716. This may open up the orifice 749, thereby increasing the orifice 749 to the first orifice diameter 752-1.

FIG. 7-4 is a transverse cross-sectional view of the pressure control valve 726 of FIG. 7-2 in the closed position, according to at least one embodiment of the present disclosure. In the view shown, the tip 766 of each valve member 762 has been extended into the orifice 749, which has reduced the orifice 749 to the second orifice diameter 752-2. As the tip 766 is extended into the orifice 749, the valve members 762 slide against their neighboring valve member 762 along the sliding connection 764.

The embodiment shown in FIG. 7-1, FIG. 7-2, FIG. 7-3, and FIG. 7-4 is an example of an active pressure control valve 726. An active pressure control valve 726 may change the orifice diameter 752 independent of the drilling fluid properties. This may allow an operator to increase or decrease the pressure differential uphole (e.g., at the port 232 to the expandable pistons 236 of FIG. 2) of the pressure control valve 726. Furthermore, the valve members 762 are positionable between two positions: fully open (e.g., with the first orifice diameter 752-1) and fully closed (e.g., with the second orifice diameter 752-2). Two positions with the pressure control valve 726 may be easy to install, maintain, and have a low failure rate. In this manner, the operator may change the pressure differential based on any input, such as the formation characteristics, the wellbore trajectory, other input, or combinations of the foregoing. In at least one embodiment, this improves wellbore quality, improves wellbore trajectory, decreases wellbore costs, increases the penetration rate, or combinations thereof.

Figure 8:
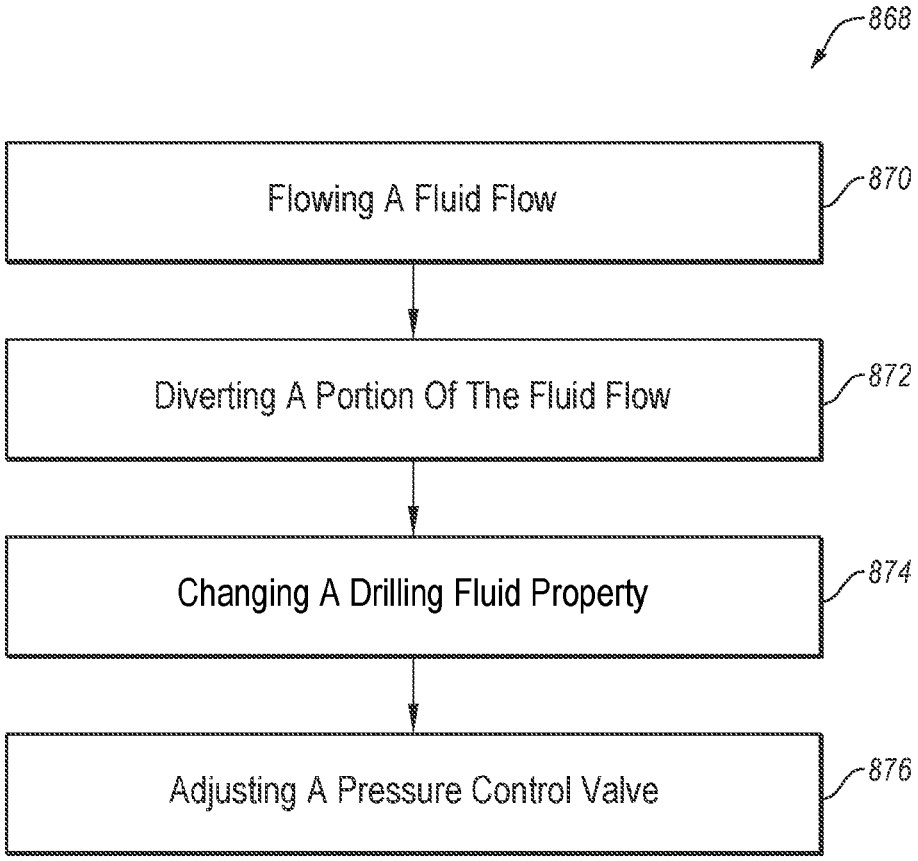
FIG. 8 is a representation of a method for controlling downhole pressure, according to at least one embodiment of the present disclosure.

FIG. 8 is a representation of a method 868 for controlling pressure at a downhole tool, according to at least one embodiment of the present disclosure. The method 868 includes flowing a fluid flow through a bore in a housing at 870. The bore includes a pressure control valve. The fluid flow has a first drilling property and a first pressure differential above the pressure control valve. The method includes diverting a portion of the fluid flow to the downhole tool uphole of the pressure control valve at 872. The downhole tool may include any downhole tool operable or influenced by fluid pressure. For example, the downhole tool may be an expandable piston on a rotary steerable system (RSS). In other examples, the downhole tool may be a reamer or other expandable tool. In some examples, the downhole tool may be power generation system.

The method may include changing the first drilling property to a second drilling property at 874. For example, the drilling property may include any fluid property, including fluid density, volumetric flow rate, and so forth. The method may further include adjusting a flow restrictor of the pressure control valve with an actuator in response to changing the first drilling property to the second drilling property at 876. Adjusting the flow restrictor may maintain or substantially maintain the first pressure differential above the pressure control valve.

The embodiments of the pressure control valve have been primarily described with reference to wellbore drilling operations; the pressure control valves described herein may be used in applications other than the drilling of a wellbore. In other embodiments, pressure control valves according to the present disclosure may be used outside a wellbore or other downhole environment used for the exploration or production of natural resources. For instance, pressure control valves of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. Changes that come within the meaning and range of equivalency of the claims are to be embraced within their scope.

What is claimed is:

1. A downhole flow system, comprising:

a housing including a bore therethrough, a fluid flow flowing through the bore;

a port directing a portion of the fluid flow to a downhole tool, the downhole tool being operable by the portion of the fluid flow; and a pressure control valve in the bore, the pressure control valve being located downhole of the port, the pressure control valve including:

a flow restrictor; and an actuator connected to the flow restrictor, the actuator changing a position of the flow restrictor to adjust a pressure differential uphole of the pressure control valve in response to a change in a property of the fluid flow.

2. The system of claim 1, the downhole tool including an expandable tool.

3. The system of claim 1, the flow restrictor including:

a stator across the bore, the stator including an opening; and a rotor, the rotor selectively blocking the opening.

4. The system of claim 1, the flow restrictor including:

an orifice having an orifice diameter; and a restrictor body having a restrictor diameter greater than the orifice diameter, the restrictor body being movable relative to the orifice.

5. The system of claim 1, the flow restrictor including an adjustable orifice diameter.

6. The system of claim 1, the actuator changing the position of the flow restrictor between more than two positions.

7. The system of claim 1, the actuator changing the position continuously between a high pressure position and a low pressure position.

8. The system of claim 1, the actuator including a linear actuator.

9. The system of claim 1, an entirety of the fluid flow downhole of the port flowing through the pressure control valve.

10. A The downhole flow system of claim 1, wherein the flow restrictor includes a choke body in the bore, the choke body including an orifice having an orifice diameter less than the bore diameter, the flow restrictor further including a restrictor body having a diameter greater than the orifice diameter; and wherein the actuator comprises a resilient member urging the choke body toward the restrictor body.

11. The system of claim 10, the choke body moving in response to the fluid flow.

12. The system of claim 11, the choke body moving in response to changes in the fluid flow.

13. The system of claim 10, a restrictor offset between the restrictor body and the choke body being greater than zero when the choke body is in a closed position.

14. The system of claim 10, the resilient member being a disc spring.

15. A method for controlling pressure at a downhole tool, comprising:

flowing a fluid flow through a bore in a housing, the bore including a pressure control valve, the fluid flow having a first drilling property and a pressure differential uphole of the pressure control valve;

directing a portion of the fluid flow to said downhole tool, the downhole tool being located uphole of the pressure control valve;

changing the first drilling property to a second drilling property; and adjusting a flow restrictor in the pressure control valve with an actuator in response to changing the first drilling property to the second drilling property, wherein adjusting the flow restrictor maintains the pressure differential above the pressure control valve.

16. The method of claim 15, wherein changing the first drilling property includes changing a density of the fluid flow.

17. The method of claim 15, wherein changing the first drilling property includes changing a volumetric flow rate of the fluid flow.

18. The method of claim 15, wherein adjusting the flow restrictor includes actively adjusting the flow restrictor.

19. The method of claim 18, wherein actively adjusting the flow restrictor includes measuring the change in the first drilling property.

20. The method of claim 15, wherein adjusting the flow restrictor includes passively adjusting the flow restrictor.

* * * * *